United States Patent [19]

Lillie

[11] Patent Number: 4,649,576

[45] Date of Patent: Mar. 17, 1987

[54] FOOT-ACTUATED TOILET SEAT LIFTING DEVICE

[76] Inventor: David A. Lillie, 3305 4th St., Boulder, Colo. 80302

[21] Appl. No.: 657,828

[22] Filed: Oct. 5, 1984

[51] Int. Cl.[4] ..... A47K 13/00

[52] U.S. Cl. ..... 4/251; 4/253; 4/308

[58] Field of Search ..... 4/251, 661, 253, 308; 220/263; 74/512, 513, 514

[56] References Cited

U.S. PATENT DOCUMENTS

| | | | |
|---|---|---|---|
| 892,116 | 6/1908 | Becker | 74/512 |
| 1,505,472 | 8/1924 | Kuno | 4/251 |
| 2,410,854 | 11/1946 | Zulkoski | 4/251 |
| 3,869,279 | 3/1975 | Grimes et al. | 74/513 |
| 4,030,146 | 6/1977 | Pilkington et al. | 4/251 |
| 4,059,025 | 11/1977 | Waack et al. | 74/513 X |
| 4,103,371 | 8/1978 | Wilson | 4/251 |
| 4,470,161 | 9/1984 | Seabrooke | 4/251 |

*Primary Examiner*—Henry K. Artis
*Attorney, Agent, or Firm*—Jon R. Stark

[57] ABSTRACT

A foot actuated toilet seat lifter is disclosed in which a base member of substantially triangular cross-section is placed on the floor with the apex down. Foot pressure on one surface of the base pivots the base about the apex, causing a shaft to press upward on a bracket attached to the toilet seat, thus lifting the seat. A variety of base shapes are disclosed, together with a bellows for damping seat lowering, and optional means for securing the base to the floor or carpet. All parts are removable to aid in cleaning, and may be installed or removed without tools. The base member may optionally have a continuously curving lower surface, or may be formed of angled material to achieve the same effect as a triangular member. The resulting devices have the advantage of employing very few parts when compared to some prior art lifters.

15 Claims, 9 Drawing Figures

FOOT-ACTUATED TOILET SEAT LIFTING DEVICE

BACKGROUND OF THE INVENTION

This invention relates to the field of toilet seat lifters, and more particularly, to toilet seat lifters which may be operated by applying pressure with the user's foot.

Many prior art toilet seat lifting devices are known, which permit the user to raise a toilet seat by stepping upon a pedal. By the use of levers, rods, cables, or fluid-displacing pistons, the force of the user's foot is transmitted to the toilet seat, so that the seat may be lifted without soiling the hands and without the nuisance of bending down to reach the seat.

Although some such prior art devices are functional, they have not achieved wide acceptance and use in the United States. This lack of acceptance is believed to be due, at least in part, to several disadvantages inherent in the design of prior art devices. Some devices, such as that disclosed in U.S. Pat. No. 3,055,016 of Kemp, are mechanically complex, and could therefore be prohibitively expensive to manufacture. Simpler and perhaps less costly devices, such as that disclosed in U.S. Pat. No. 1,999,070 of Svedelius, have failed to provide any form of adjustment to fit toilets of varying height. Where adjustment has been provided, such as in the device of U.S. Pat. No. 3,504,385 of Fields, the adjustment may require the use of tools. Tools have also been necessary for the installation of most prior art devices, which must be rigidly attached to the toilet and/or to the floor nearby to permit proper functioning. In addition to the inconvenience of the need to use tools for installation and adjustment, the practice of rigid, permanent attachment has made cleaning of the toilet unnecessarily awkward, since the device may not be easily removed for regular cleaning.

A simple device is needed, which uses a minimum number of parts, which avoids costly bearings, linkages, and other mechanisms which complicate the device and drive up manufacturing and retail costs, which can be easily installed or removed without the use of tools, which is adjustable for varying toilet heights, and which is readily removable for cleaning.

SUMMARY OF THE INVENTION

In accordance with the preferred embodiment of the present invention, a toilet seat lifting device employs a base member which is approximately a triangular prism in shape. A shaft is pivotably attached near one extreme of the base, and the base is placed on the floor so that the apex of the triangle shape may serve as a fulcrum. Foot pressure on the other extreme of the base causes the base to rock about the fulcrum, applying an upward force to the shaft. The shaft terminates at its upper end in an eye which may be adjusted for height without the use of tools. A bracket attached to the toilet seat lid is fitted through the eye, providing a detachable connection. If desired, a flexible strap may be fixed to the underside of the base, and attached by hook and loop fasteners to the bathroom carpet, or by screws to the floor. This strap may be made of a springy material to assist in lifting the seat.

Another embodiment provides optional locking action in the up position, by permitting the base to be placed so that the shaft is vertically positioned forward of the fulcrum point while the toilet seat is raised. Another alternative replaces the triangular prism base with an angled lever which has a lower surface which generally conforms to the shape of the two lower surfaces and apex of the triangular embodiments. Yet another embodiment utilizes a continuously curved lower surface in place of the intersecting planes which form the apex of the triangular prism. Each embodiment may be equipped with a bellows under the base to provide damping action for lowering the seat.

Simplicity and low cost of manufacture are provided, plus easy adjustment and installation without tools, and easy removal for cleaning. Apparatus according to the invention avoids the necessity of using complex linkages, bearings, pivots, and so forth, resulting in a substantial reduction in the number of parts when compared to many prior art devices.

FIGS. *5a* and *5b* are views of alternative base configurations.

FIGS. *6a* and *6b* are views of a bellows and bellows valve, respectively.

Figure 7:
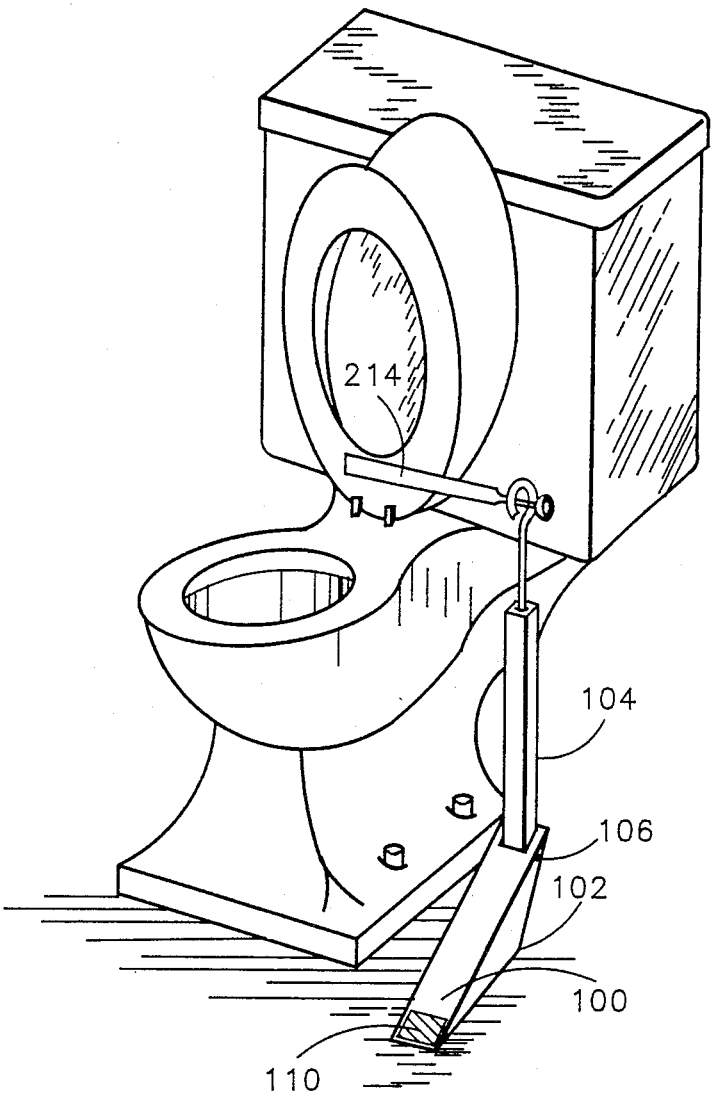

FIG. 7 is a perspective view of a toilet equipped with a seat lifter according to the invention.

DESCRIPTION OF THE PREFERRED EMBODIMENTS

Figure 1:
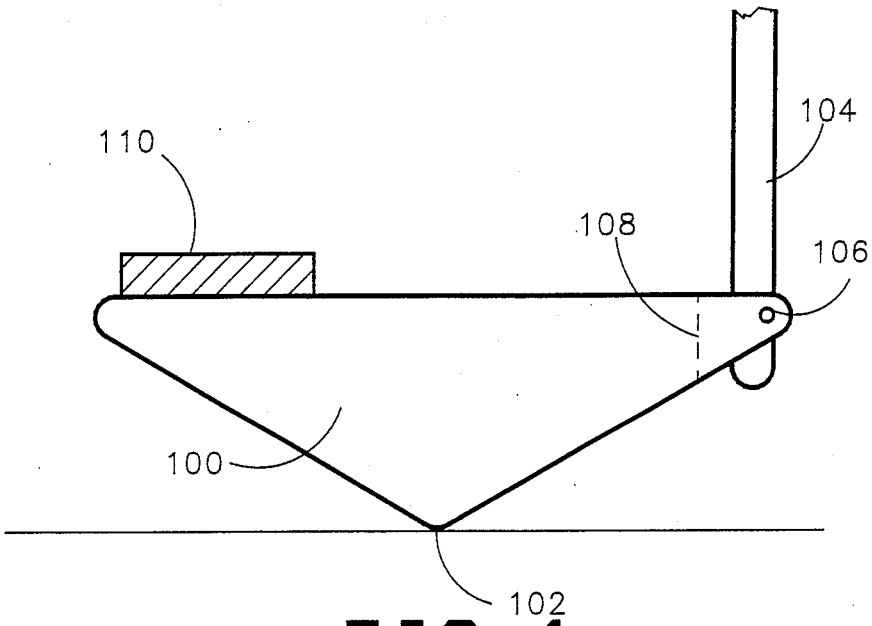
FIG. 1 is side view of a base and shaft assembly.

A preferred embodiment of the present invention employs a base unit which is depicted in FIG. 1. Base member 100 is shaped to approximate a triangular prism, with apex 102 appearing at the bottom. A shaft 104 may be pivotably attached to base member 100 by a pin 106 which passes through holes in both the base member and the shaft. Dotted line 108 indicates the limit of a channel, hidden in this view, through which shaft 104 descends into base member 100 for alignment of holes for pin 106.

A pedal surface 110 is provide on top of base member 100 to receive the foot of a user of the device. Foot pressure on pedal surface 100 will cause the base member 100 to rock or pivot about apex 102, which acts as a fulcrum. This rocking action will force pin 106 to exert an upward force on shaft 104, of roughly equal magnitude to that applied to surface 110 by the foot.

Base member 100 may be easily and inexpensively formed from a block of wood, requiring minimal shaping to achieve the triangular prism form, and the provision of a channel for shaft 104 and a hole for pin 106. Plastic or other inexpensive materials may be substituted if desired. The pedal surface 110 is depicted in FIG. 1 as an applied non-skid surface such as a rubber pad, but it may be produced by texturing the upper surface of base member 100, or merely leaving the base member smooth, as desired.

Figure 2:
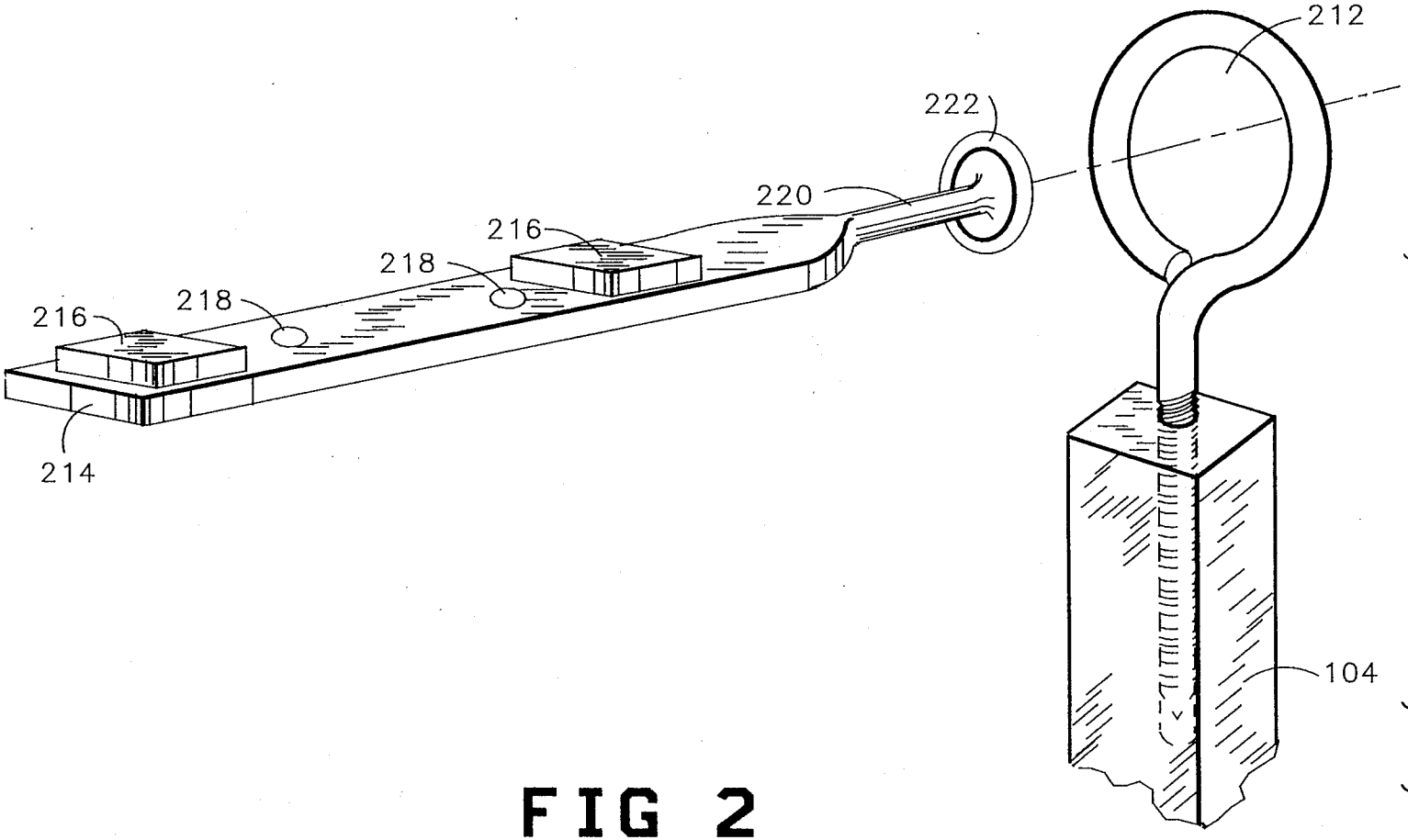
FIG. 2 is an exploded perspective view of of a seat bracket and shaft assembly.

The upper end of shaft 104 is depicted in FIG. 2. An eye 212 is provided for attachment of a bracket 214. Eye 212 is preferrably formed at the end of self-tapping wood screw which may be inserted into the end of shaft 104. If shaft 104 is made of wood, plastic, or other relatively soft materials, and is provided with a pilot hole, then eye 212 may be positioned by hand by screwing the threads into the shaft material. The width of the eye will provide sufficient leverage for the fingers to yield the driving torque needed, and no tools will be required for assembly. The effective length of shaft 104 can be adjusted, for use with toilets of differing heights, by the extent to which the screw threads are driven into the shaft.

Although the shaft 104 and base member 100 are described above as two separate pieces to be connected by a pin 106, a slightly different construction technique is optional. The base member and shaft may be formed entirely of plastic, and may be joined by a "live" plastic hinge, that is, a thin flexible section of plastic between the two elements which allows the shaft to move with respect to the base when the hinge flexes. In this option, no connecting pin is required, and the pivoting action afforded by a pin is instead provided by the plastic hinge. This construction option may be advantageous for simple, low cost, one piece manufacture of the base and shaft elements.

Bracket 214 is designed for attachment to the underside of the toilet seat, slightly forward of the seat hinges. Attachment may be easily achieved without tools by use of self-adhesive pads 216. If a more permanent mounting is desired, to discourage theft or abuse, screws may be used through mounting holes 218, but adhesive pads are sufficiently secure for normal operation. A coupling 220 with a flanged end 222 extends outward from bracket 214, for connection to eye 212. After eye 212 has been adjusted to the proper position on shaft 104, the eye may be angled slightly and slipped over the edges of flange 222. The flange will prevent eye 212 from becoming detached in ordinary use of the seat lifter, but may be quickly detached for removal of the lifter shaft and easy cleaning of the toilet by simpling angling the eye once more and slipping it off. While the coupling and the eye are assembled, the coupling will prevent the eye from turning and thus prevent the shaft adjustment from being inadvertently changed.

Once the bracket, eye, shaft, and base are assembled, the base will rest on the floor, and the shaft will extend upward to the eye connection with the bracket mounted on the toilet seat. Foot pressure on the pedal surface, as described above, will rock the base, force the shaft upward, press the coupling and bracket upward, and thus raise the toilet seat. In normal use, the effective shaft length will be adjusted by screwing in the eye-carrying screw until the full travel of the rocking base will leave the toilet seat slightly short of the full open position. This leaves a slight downward load on the shaft, requiring some downward force on the pedal surface to overcome the weight of the seat. When the lifter is adjusted in this fashion, the seat may be lifted to its full open position by hand, if desired. This will simply pull upward on the shaft and slightly lift the base member, without interfering with operation of the seat for cleaning or other purposes.

Figure 3:
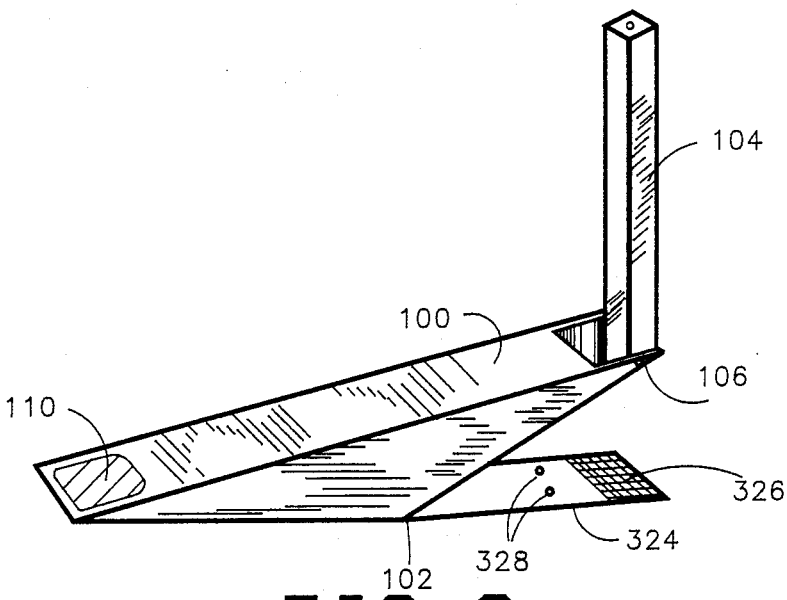
FIG. 3 is a perspective view of a base and floor attachment.

In the preferred embodiment, the base member need not be attached to the floor or to the toilet. The only "permanent" connection required is the adhesive attachment of the bracket to the toilet seat underside, and this connection may be undone if it is desired to completely remove the lifter, as when moving to a new residence. In normal operation, the base member will simply rest upon the floor or carpet, rocking about the fulcrum formed by the apex of the triangular shape when foot pressure is applied. The base may be moved back out of the way of a seated person's heels, if desired, and moved forward for use. If excessive slippage of the base on a floor or rug is encountered in normal use, the base may be secured by the methods shown in FIG. 3. A thin strip of flexible material 324 may be affixed to the underside of the base member. FIG. 3 shows the base in the position corresponding to a lifted seat, and the flexible material is preferrably affixed to that surface of the base which is horizontal in this view. The material extends from that surface back under the apex or fulcrum and lies beneath the other apex-forming surface, which is now raised to a position above horizontal. For securing the base to the rug or floor, strip 324 may carry a patch 326 of hook and loop material to engage carpet fibers, or a small patch of adhesive in the same location. Screw holes 328 may be provided to secure the device against theft or vandalism.

If desired the strip 324 may be made of spring steel or other resilient materials. The spring action which results may be exploited to reduce the force necessary to raise the seat, with a counterbalancing effect.

Figure 4:
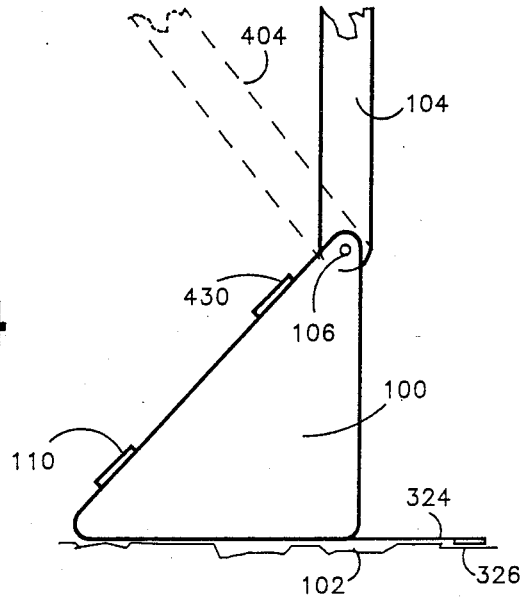
FIG. 4 is a side view of a base with optional locking in the up position.

Another embodiment of the invention provides the ability to "lock" the toilet seat in the raised position. This optional feature is illustrated in FIG. 4, which shows the device in the raised and locked position. Reference numerals in FIG. 4 refer to the same numbered elements in the earlier figures.

The base member shown in FIG. 4 differs from that shown before only in the included angle formed by the lower surfaces of the base at the apex. The earlier embodiments were shown with an obtuse angle at the intersection of the lower surfaces. By using a substantially right angle instead, locking action can be achieved. Note that the pin 106 lies slightly ahead of the apex 102, and that shaft 104 bears down in a direction which forces the base to rest against the forward lower surface. This produces a stable configuration which requires no pedal pressure to keep the seat in the raised position. To obtain this function, it is only necessary to move the base forward or backward along the side of the toilet until the proper shaft angle is reached. Once this location is found, the base member may be secured as shown in FIG. 3, if desired. To release the seat from the locked position, one need only apply slight pressure at the point marked 430. Note that the locking action is entirely optional; if the base is moved slightly farther back, the shaft will be angled as shown by the dashed-lined shaft 404, and normal non-locking operation will result.

A right angle at the base apex is not essential to the locking option. The same effect can be achieved with an obtuse angle, if the location of pin 106 is moved far enough toward the pedal surface to produce the same geometric relationship of the pin to the apex as one would have with the right angle construction. However, since moving the pin inward reduces the lever arm between the apex and the pin to the same extent that reducing the angle would, there is no real advantage to using an obtuse angle with the locking option, and some waste of material can result.

If desired, the base may equipped with more than one mounting point for pin 106. By providing a number of different mounting points, the user can select to have the "locking" feature available or not, as appropriate. An advantage of this construction is that some variation in the effective height of the complete device can be achieved. In combination with the adjustment provided by the eye-carrying screw, the ability to move pin 106 back and forth toward the pedal surface will allow the device to be used over a great range of toilet heights. This additional range may be sufficiently desirable to overcome the slight cost of providing extra holes in the base member. In any event, the use of an obtuse apex angled base, with multiple pin-mounting holes placed to allow both locking and non-locking operation, will allow the user the flexibility to chose the pin and apex relationship which suits the user at any given time, requiring only a few moments to reposition pin 106 and to adjust the eye position to suit.

Figure 5A:
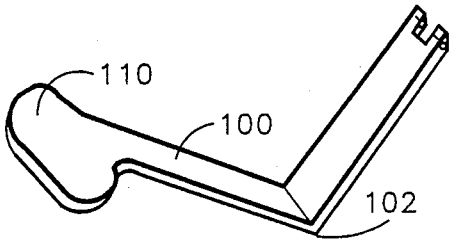

The base members discussed so far have been described as triangularly shaped bodies. Some variations on this shape can also produce desirable results. One example is shown in FIG. 5*a*, which depicts a base member in the form of an angled lever. The lower surfaces of this base are identical in shape and function to the lower surfaces of the triangular bodies described above, and an apex which serves as a fulcrum is formed by the intersection of the surfaces in much the same manner. The material which would ordinarily "fill out" the triangular body has been left out. Such a shape may be more convenient to manufacture cheaply with certain materials. For example, one might wish to easily shape a triangular base member by a few cuts on a block of wood, but prefer to use the shape shown in FIG. 5*a* when metal is used, since it could be formed by bending. Note that the pedal surface in this embodiment is on the top side of the forward portion of the angled member. To present a wider surface for the foot to contact, the pedal portion may be broadened somewhat as shown.

Figure 5B:
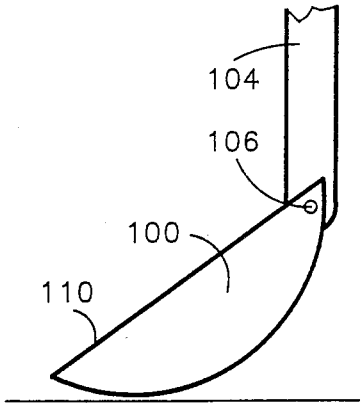

FIG. 5*b* shows a base member with a continuously curved lower surface, instead of the intersecting substantially planar surfaces depicted in the other figures. This embodiment will function in a fashion similar to that already described, except that the fulcrum point will travel along the curved surface as the base member is rocked, instead of remaining substantially at the same apex point. One advantage of this shape is that the curved surface will permit a large lifting range to be achieived with relatively small base dimensions.

Figure 6A:
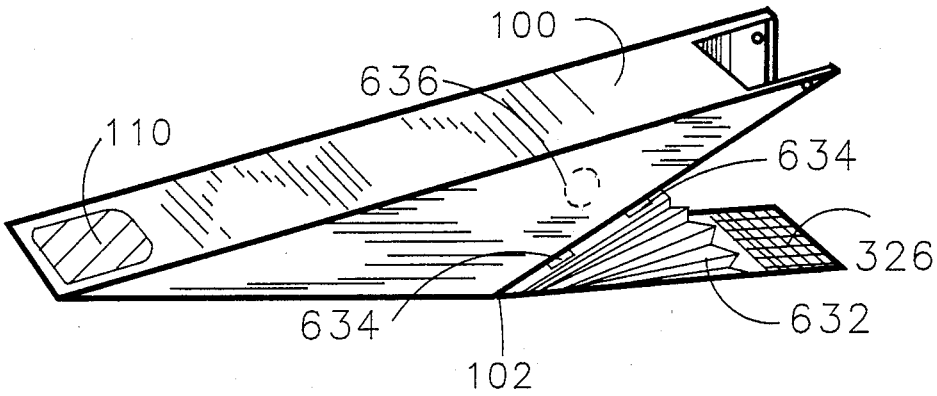
Figure 6B:
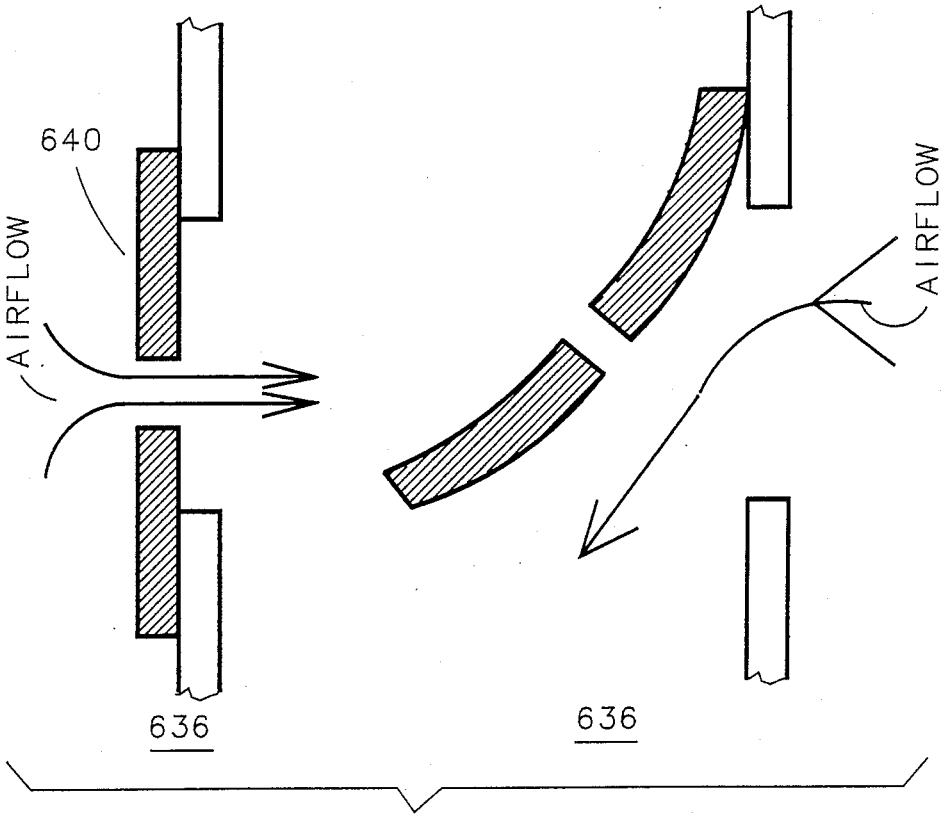

As an option in any of the embodiments discussed above, a bellows device may be provided for mild damping of the downward travel of the seat when the pedal is released. As shown in FIG. 6*a*, a bellows 632 is placed under the base member so that it will be compressed when the base member rocks back to the seat down position. Spacers 634 provide a gap to permit air to escape from a valve 636 in the bellows facing the base member. The valve 636 may be constructed as shown in FIG. 6*b*. A flapper will be in the position indicated as 638 while air is rushing in during lifting, and will return to the position shown as 640, greatly restricting the airflow, while air is escaping during lowering of the seat.

A complete device, as used with a typical toilet installation, is depicted in FIG. 7 to illustrate the relationships of the various components. The invention permits simple and economical manufacture, easy installation with no tools, adjustment for varying heights of toilets without tools, easy removal for cleaning, and optional locking and damping features. Convenient foot operation allows for hygienic use without bending over.

When compared with many prior art devices, the invention can be seen to provide a simple design which eliminates many parts. No expensive bearings, pivots, gas cylinders, or other costly mechanisms are employed, which reduces the cost of manufacture and the price at which the devices may be sold, without reducing the utility or effectiveness of the device. Indeed, the ready adjustability and removability of devices according to the invention enhance their desirability, and their simplicity enhances economically efficient production.

The foregoing embodiments are presented to illustrate the invention, but not to limit it. The scope of the invention is defined only by the appended claims.

I claim:

1. Foot actuated toilet seat lifting apparatus comprising:

a pivotable base member having a pedal surface and first and second lower surfaces, the first lower surface having a shaft end and an apex end, the second lower surface having a pedal end and an apex end, the first and second lower surfaces intersecting at their apex ends at a predetermined non-acute included angle to form an apex disposed below the pedal surface and in contact with a floor surface, the base member being pivotable on the floor surface about the apex in response to foot pressure on the pedal surface;

shaft means pivotally connected to the base member sustantially at the shaft end of the first lower surface;

bracket means for attachment to the underside of a toilet seat; and attachment means for removably connecting the shaft means to the bracket means;

the shaft means being upwardly displaceable by pivoting of the base member to exert an upward pushing force on the bracket means.

2. Apparatus as in claim 1 wherein the base member is a solid of substantially triangular cross-section.

3. Apparatus as in claim 1 wherein the shaft means comprises a shaft having an upper end and a lower end, the lower end being connected to the base member, the upper end having an eye for removably receiving a flanged rod.

4. Apparatus as in claim 3 wherein the attachment means comprises a flanged rod for removable placement within the eye of the shaft means, connected to the bracket means.

5. Apparatus as in claim 1 further comprising bellows means for air damping of motion, connected to the base member between the first lower surface and the floor, said bellows means being under compression and providing a resisting force when the toilet seat is being lowered.

6. Apparatus as in claim 1 wherein the included angle at the apex of the first and second lower surfaces of the base member is substantially a right angle.

7. Apparatus as in claim 1 further comprising securing means to prevent movement of the base member across the floor.

8. Apparatus as in claim 2 wherein the shaft means comprises a shaft having an upper end and a lower end, the lower end being connected to the base member, the upper end having an eye for removably receiving a flanged rod.

9. Apparatus as in claim 8 wherein the attachment means comprises a flanged rod for removable placement within the eye of the shaft means, connected to the bracket means.

10. Apparatus as in claim 9 further comprising bellows means for air damping of motion, connected to the base member between the first lower surface and the floor, said bellows means being under compression and providing a resisting force when the toilet seat is being lowered.

11. Apparatus as in claim 10 further comprising securing means to prevent movement of the base member across the floor.

12. Apparatus as in claim 10 wherein the included angle at the apex of the first and second lower surfaces of the base member is substantially a right angle.

13. Foot actuated toilet seat lifting apparatus comprising:

a pivotable base member having a pedal surface and a lower surface, the lower surface having a shaft end and a pedal end, the lower surface being formed as a continuously curving convex face between the shaft end and the pedal end and disposed below the pedal surface in tangential contact with a floor surface, the base member being pivotable on the floor surface in response to foot pressure on the pedal surface;

shaft means pivotally connected to the base member substantially at the shaft end of the lower surface;

bracket means for attachment to the underside of a toilet seat; and attachment means for removably connecting the shaft means to the bracket means;

the shaft means being upwardly displaceable by pivoting of the base member to exert an upward pushing force on the bracket means.

14. Apparatus as in claim 13 wherein the shaft means comprises a shaft having an upper end and a lower end, the lower end being connected to the base member, the upper end having an eye for removably receiving a flanged rod.

15. Apparatus as in claim 14 wherein the attachment means comprises a flanged rod for removable placement within the eye of the shaft means, connected to the bracket means.

* * * * *